US007217178B2

(12) United States Patent
Oki et al.

(10) Patent No.: US 7,217,178 B2
(45) Date of Patent: May 15, 2007

(54) ROTARY POWER TOOL

(75) Inventors: Sadaharu Oki, Anjo (JP); Shin Sugiura, Anjo (JP); Shinji Hirabayashi, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 11/406,266

(22) Filed: Apr. 19, 2006

(65) Prior Publication Data

US 2006/0258274 A1 Nov. 16, 2006

(30) Foreign Application Priority Data

Apr. 20, 2005 (JP) ..... 2005-122320

(51) Int. Cl.
*B24B 23/00* (2006.01)

(52) U.S. Cl. ..... 451/359; 451/358

(58) Field of Classification Search ..... 451/358, 451/359, 352, 353, 158–161, 259–293; 173/162.1, 173/162.2, 170
See application file for complete search history.

(56) References Cited

U.S. PATENT DOCUMENTS 6,293,859 B1 * 9/2001 Fink et al. ..... 451/344
7,052,382 B2 * 5/2006 Baker ..... 451/344
2005/0087353 A1 4/2005 Oki et al.
2006/0113098 A1 * 6/2006 Inagawa et al. ..... 173/162.2
2006/0166613 A1 * 7/2006 Lamprecht et al. ..... 451/359

FOREIGN PATENT DOCUMENTS

DE 102 48 866 A1 4/2004
WO WO 2004/039541 A1 5/2004

* cited by examiner

*Primary Examiner*—Dung Van Nguyen
(74) *Attorney, Agent, or Firm*—Oliff & Berridge PLC

(57) ABSTRACT

In order to provide an effective technique in simplifying the vibration-proof structure of a handle equipped in a rotary power tool, a representative rotary power tool 101 is provided with a tool body 103, a rotary-disk shaped tool bit 115, a handle 109, a pivot region 121 and an elastic element 129. The handle 109 coupled to the tool body 103 is disposed in a predetermined initial position in which the handle 109 longitudinally extends parallel to the longitudinal direction of the tool body 103. The handle 109 can rotate with respect to the tool body 103 around the pivot region 121 in any direction crossing the longitudinal direction of the tool body 103. The elastic element 129 is disposed between the tool body 103 and the handle 109 to apply a biasing force to the handle 109 such that the elastic element 129 biases the handle 109 to return to the initial position.

7 Claims, 12 Drawing Sheets

ROTARY POWER TOOL

BACKGROUND OF THE INVENTION

1. Field of the Invention

The present invention relates to a rotary power tool that performs a predetermined operation on a workpiece by rotation of a tool bit.

2. Description of the Related Art

German Patent Application No. 10248866 discloses an electric disc grinder in which a grinding wheel as a tool bit is disposed on one end of a tool body in the longitudinal direction and a handle is disposed on the other end of the tool body. The handle is coupled to the rear end of the housing via a rubber isolator. The rubber isolator is configured as a unit of multilayer structure with a combination of a plurality of plates made of rigid materials and rubber plates and disposed between the rear end surface of the housing and the front end surface of the handle. With such construction, the rubber isolator can absorb vibration caused three-dimensionally in the housing when the disc grinder is driven. As a result, the vibration transmitted from the housing to the handle can be reduced.

However, further improvement to the rotary power tool such as an electric disc grinder is desired with respect to the rubber isolator with relatively many component parts so as to reduce manufacturing costs of the power tool.

SUMMARY OF THE INVENTION

Accordingly, it is an object of the invention to provide an effective technique in simplifying the vibration-proof structure of a handle equipped in a rotary power tool.

The object of the invention as described above is achieved by a representative rotary power tool including a tool body, a tool bit, a handle, a pivot region and an elastic element. The tool bit has a rotary-disk shape and has a rotating surface. The tool bit performs a predetermined operation on a workpiece by a rotating movement around a rotating axis that extends perpendicular to the rotating surface. The tool bit is disposed on one tip end region of the tool body such that the rotating axis extends to cross the longitudinal direction of the tool body. The handle is coupled to the tool body at the end region of the tool body opposite to the region where the tool bit is mounted. The handle is disposed in a predetermined initial position in which the handle longitudinally extends parallel to the longitudinal direction of the tool body. The pivot region is provided between the tool body and the handle. The handle can rotate with respect to the tool body around the pivot region in any direction crossing the longitudinal direction of the tool body. The elastic element is disposed between the tool body and the handle. The elastic element applies a biasing force to the handle rotated around the pivot region with respect to the tool body such that the elastic element biases the handle to return to the initial position.

The "rotary power tool" according to the invention can be suitably applied to a grinder which performs grinding or cutting operation on a workpiece by rotating a grinding wheel or a polisher which performs polishing operation on a workpiece by rotating a pad. The manner in which the handle "extends in the longitudinal direction of the tool body" widely includes the manner in which the handle extends generally linearly in the longitudinal direction of the tool body, the manner in which the handle extends in a curved manner in the longitudinal direction of the tool body, as well as the manner in which the handle extends linearly with a slight inclination in the longitudinal direction of the tool body.

Further, "any direction" in which the handle may rotate according to the invention means any vertical or lateral direction as viewed from the longitudinal direction of the body and is also refereed to as all directions. Further, the "initial position" is a position in which the handle is standing still, and more specifically a position in which the biasing force of the elastic element does not act upon the handle as a force of rotating the handle. The "elastic element" may comprise a rubber or a spring.

According to the invention, vibration transmitted from the tool body to the handle can be efficiently reduced. Further, vibration-proof structure of the handle can be realized with a simple structure in which the elastic element is disposed between the tool body and the handle that is rotatably coupled to the tool body. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved rotary power tools and method for using such rotary power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
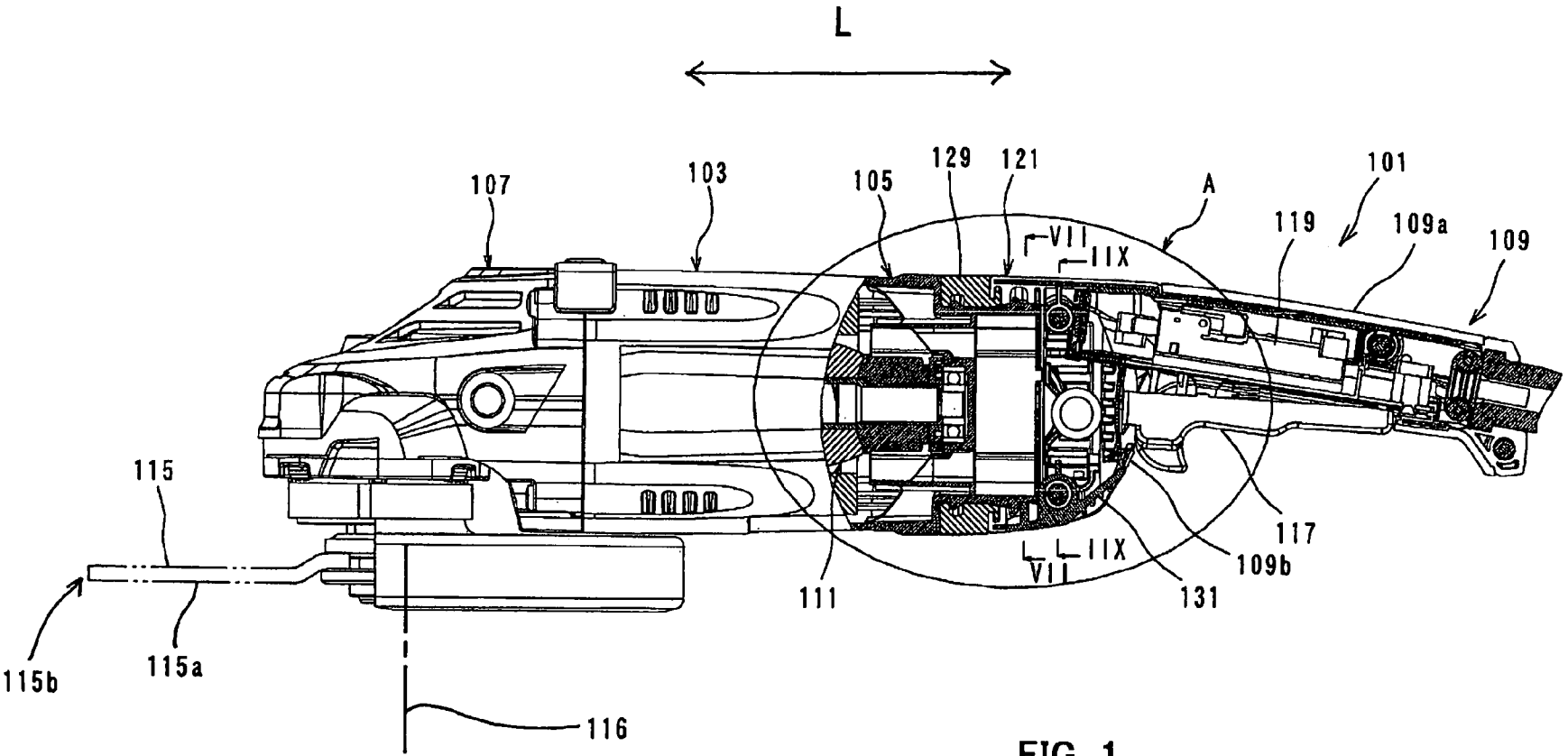
FIG. 1 is a side view, partially in section, showing an entire electric disc grinder according to an embodiment of the invention.
Figure 2:
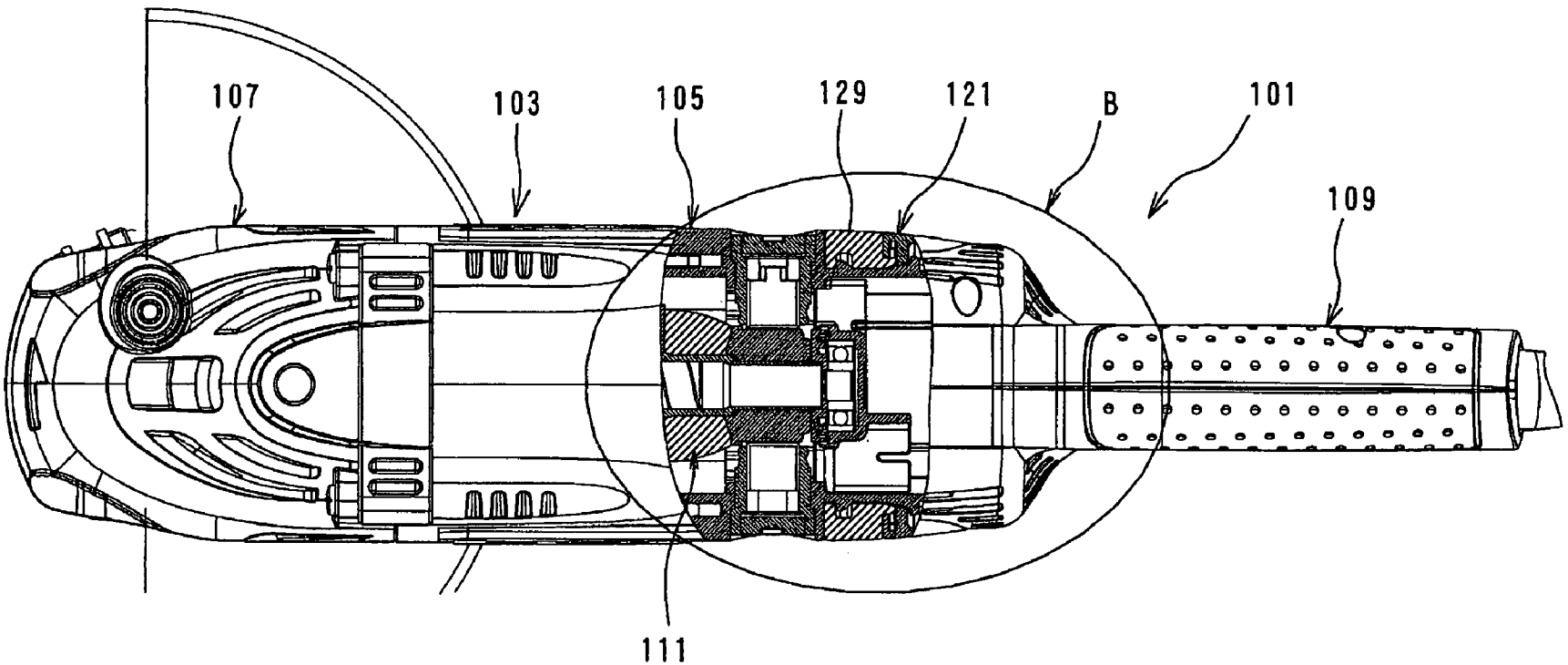
FIG. 2 is a plan view, partially in section, also showing the entire electric disc grinder.
Figure 9:
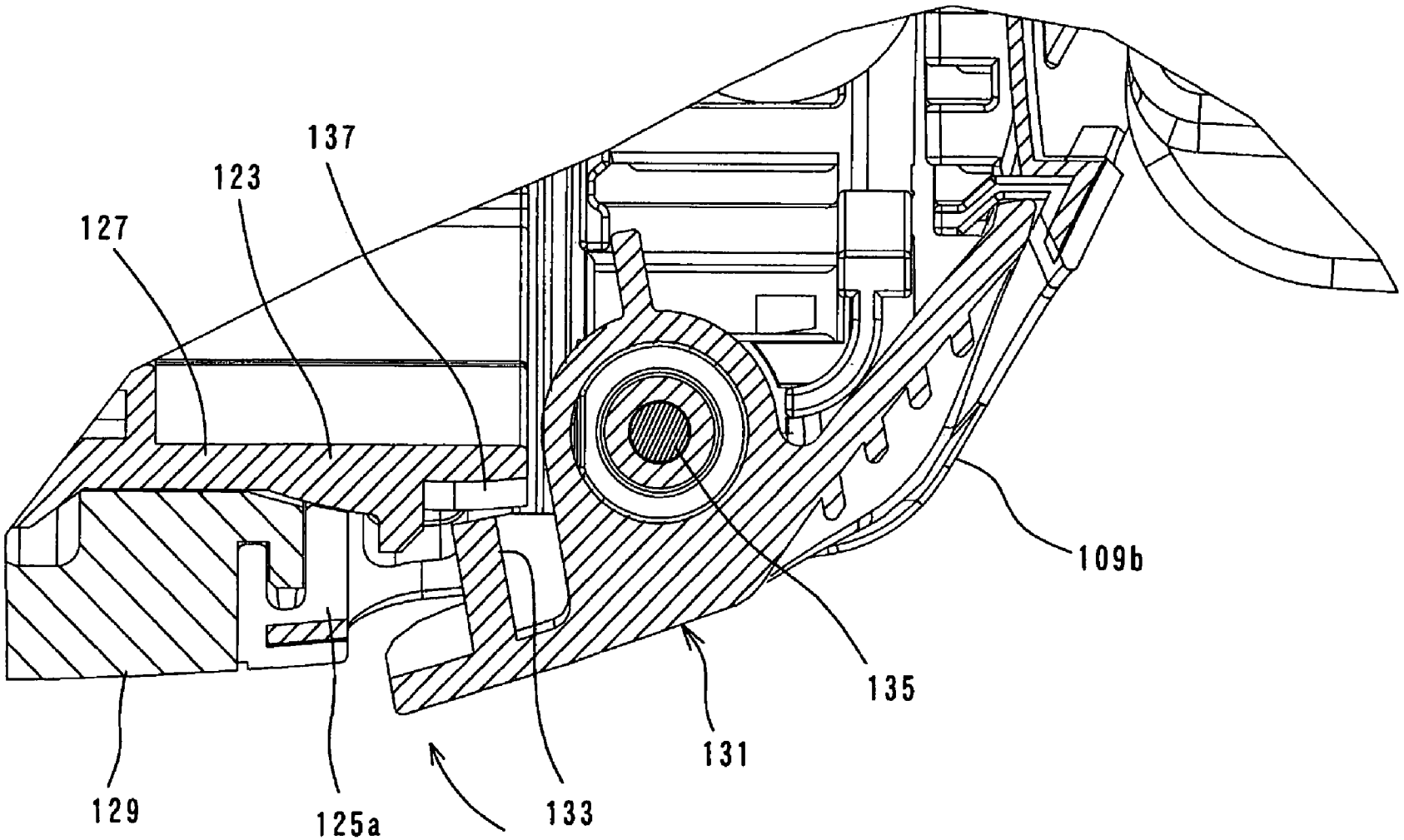
FIG. 9 is a sectional view showing a lock lever for locking the main handle against rotation.
Figure 10:
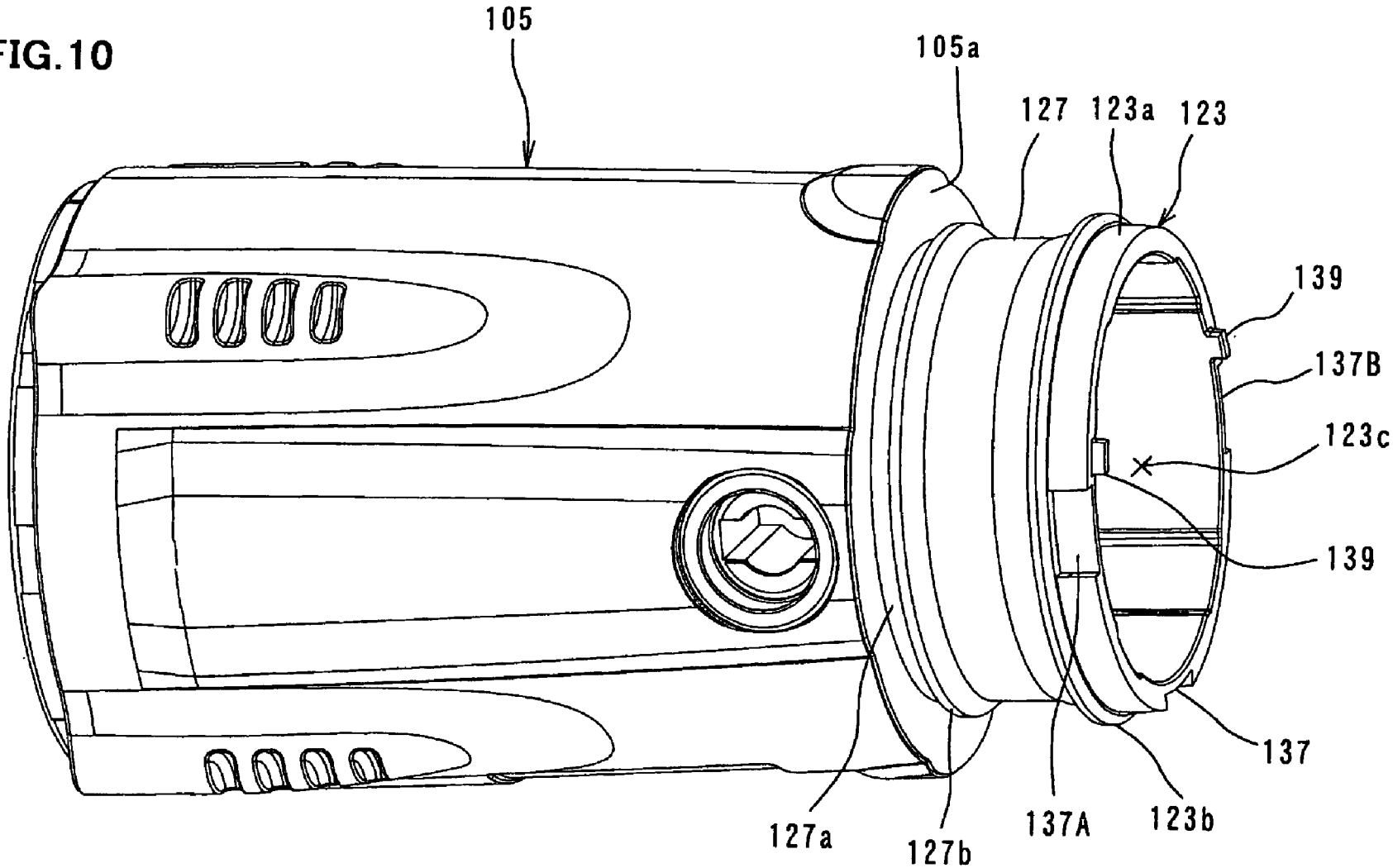
FIG. 10 is a perspective view showing an entire motor housing.
Figure 11:
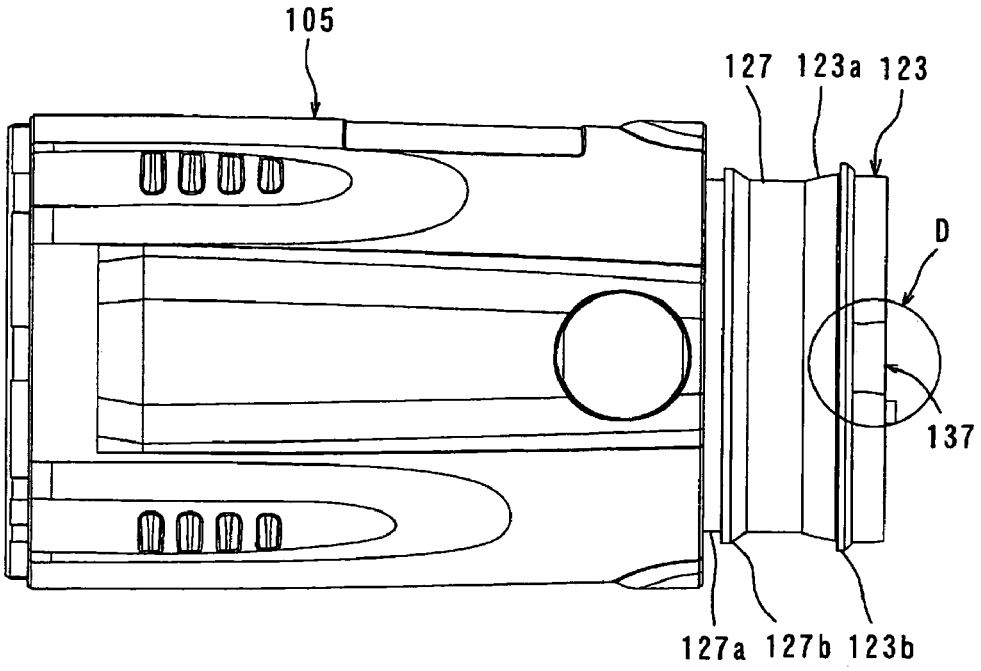
FIG. 11 is a front view showing the entire motor housing.
Figure 12:
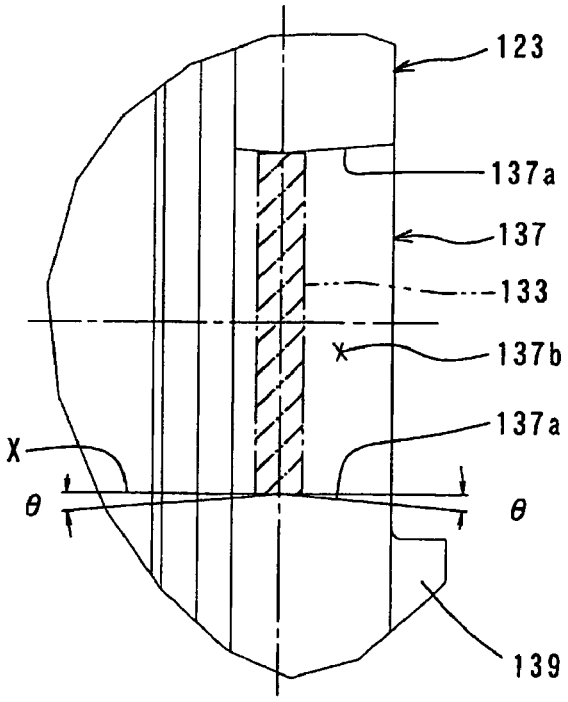
FIG. 12 is an enlarged view of circled part D in FIG. 11.
Figure 13:
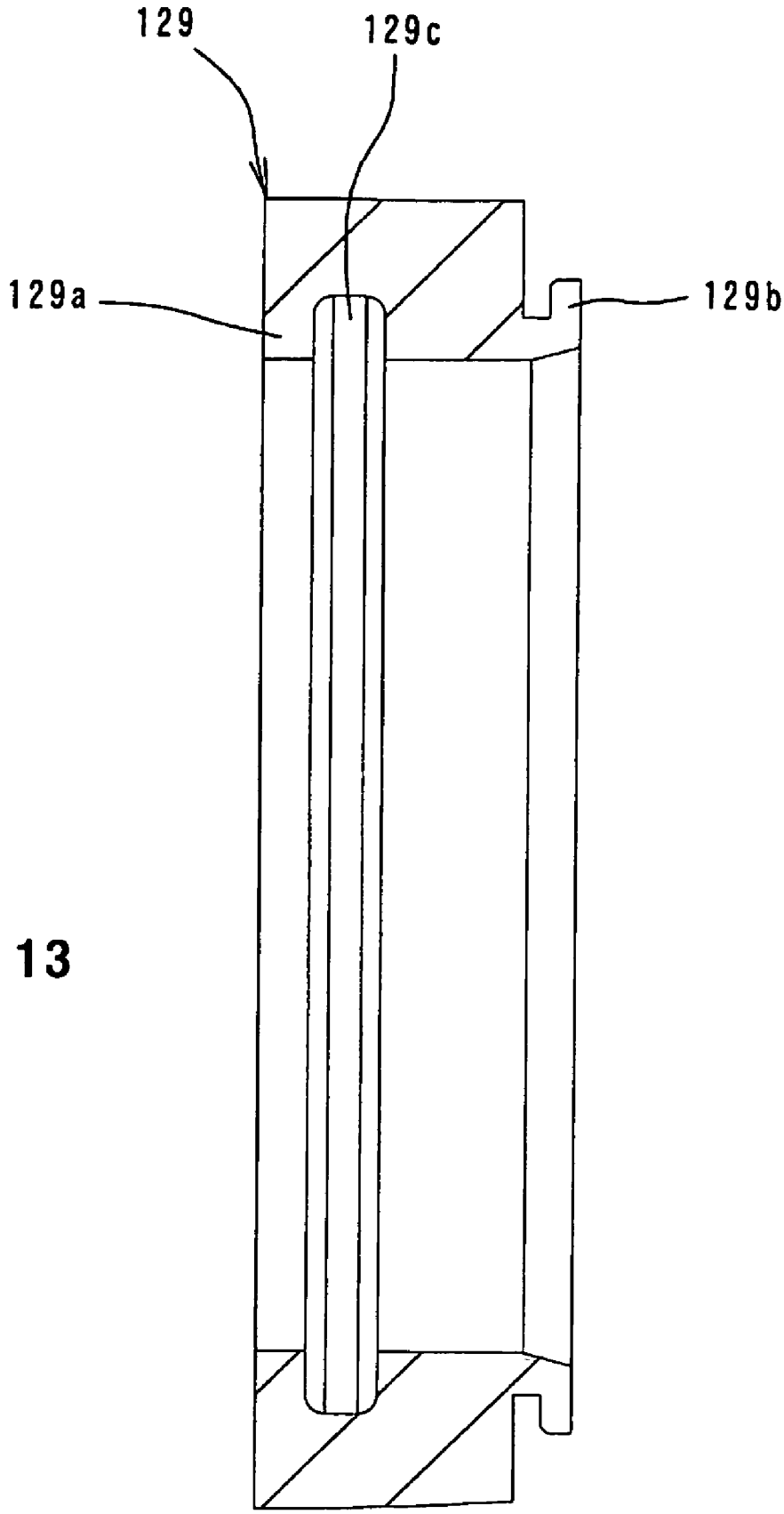
FIG. 13 is a sectional view showing a rubber isolator.

An embodiment of the present invention will now be described with reference to FIGS. 1 to 13. The embodiment of the present invention will be explained as to an electric disc grinder 101 as a representative example of a rotary power tool. FIGS. 1 and 2 show the entire disc grinder having a vibration-proof main handle. FIGS. 3 to 9 show essential parts of the present invention in section. FIGS. 10 and 11 show a motor housing in its entirety. FIG. 12 is an enlarged view of circled part D in FIG. 11. FIG. 13 shows a rubber isolator in section. As shown in FIGS. 1 and 2, the electric disc grinder 101 hereinafter referred to as grinder) has a body 103 that includes a motor housing 105 and a gear housing 107. The body 103 is a feature that corresponds to the "tool body" in the present invention. The motor housing 105 is generally cylindrically formed (see FIG. 10) and houses a driving motor 111. The driving motor 111 is arranged such that its axis of rotation extends in the longitudinal direction of the grinder 101 or the longitudinal direction of the body 103.

A power transmitting mechanism (not shown) is disposed within the gear housing 107 that is coupled to the front end of the motor housing 105 and serves to transmit the rotating output of the driving motor 111 to a grinding wheel 115. The grinding wheel 115 is having a substantially rotary disk shape with rotating surface 115*a* and a rotating circumference 115*b*. The grinding wheel 115 coupled to the gear housing 107 rotates around a rotating axis 116 such that rotating surface 115*a* performs a predetermined grinding operation to the work, otherwise the rotating circumference 115*b* performs a predetermined cutting operation to the work.

The grinding wheel 115 is a feature that corresponds to the "tool bit" in the present invention. The rotating output of the driving motor 111 is transmitted to the grinding wheel 115 as rotation in the circumferential direction via the power transmitting mechanism. The grinding wheel 115 is disposed on one end (the front end) of the disc grinder 101 in the longitudinal direction such that its axis of rotation is perpendicular to the longitudinal direction of the body 103 (the axis of rotation of the driving motor 111). Further, a main handle 109 is coupled to the other end (the rear end) of the motor housing 105. The main handle 109 is a feature that corresponds to the "handle" in the present invention.

The main handle 109 is disposed such that its longitudinal direction coincides with the longitudinal direction of the body 103. In other words, the main handle 109 extends generally linearly in the longitudinal direction of the body 103. The main handle 109 as shown in FIG. 1 is corresponding to "handle disposed in a predetermined initial position in which the handle longitudinally extends parallel to the longitudinal direction of the tool body" according to the invention.

Further, in the case of the grinder 101 of a large size (which is not shown), in addition to the main handle 109, an auxiliary handle is provided which is removably mounted on the side or upper surface of the gear housing 107 such that its longitudinal direction is generally perpendicular to the longitudinal direction of the body 103. User holds the main handle 109 and the auxiliary handle by hands when grinding or cutting a workpiece by rotation of the grinding wheel 115.

Next, the vibration-proof structure of the main handle 109 will be explained with reference to FIGS. 3 to 8. The main handle 109 is a hollow cylindrical member, and its front end is coupled to the rear end of the motor housing 105 which forms the body 103, via a spherical portion 123 and a spherical concave portion 125. The concave portion 125 engages with the spherical portion 123 such that it can rotate with respect to the spherical portion 123. The spherical portion 123 and the concave portion 125 form a coupling region 121 for coupling the main handle 109 to the body 103. The spherical portion 123 and the concave portion 125 that form the coupling region 121 engage in sliding contact with each other, and the axial direction of the spherical portion 123 coincides with the longitudinal direction of the body 103.

The spherical portion 123 is integrally formed with the motor housing 105. Specifically, a hollow cylindrical portion 127 is integrally formed with the motor housing 105 and extends a predetermined length rearward from the rear end of the motor housing 105. Further, the spherical portion 123 is contiguously formed with the rear end of the cylindrical portion 127 (see FIG. 10). The outer surface of the spherical portion 123 comprises a spherical surface 123*a* having a radius R with its center P on the axis of the spherical portion 123. Further, the outer diameter of the cylindrical portion 127 is smaller than the outer diameter of the motor housing 105. Thus, a vertical end surface 105*a* is formed on the border between the motor housing 105 and the cylindrical portion 127 and extends perpendicularly to the motor housing 105.

Figure 6:
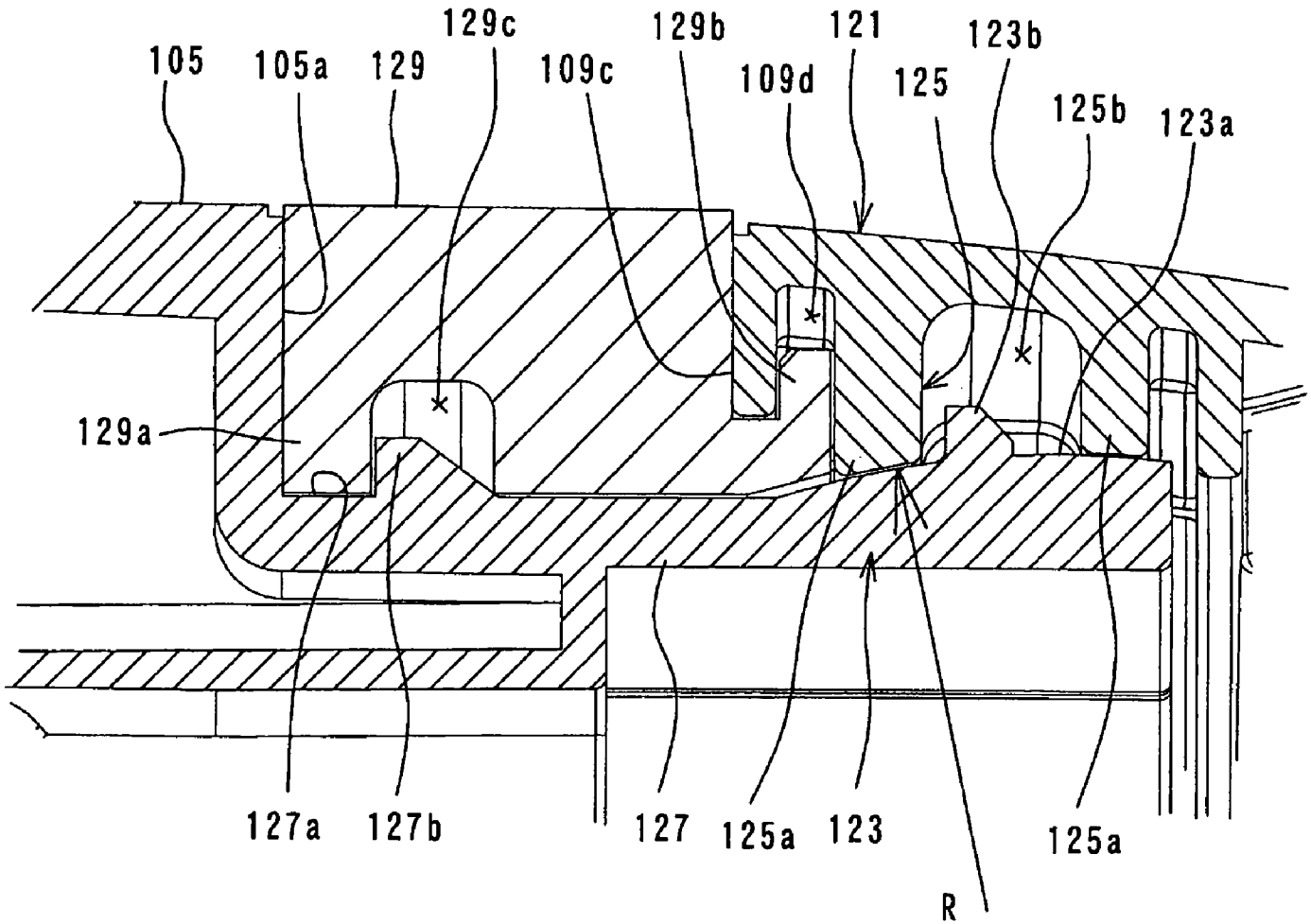
FIG. 6 is an enlarged view of circled part C in FIG. 5.

The concave portion 125 is integrally formed with the main handle 109. Specifically, the main handle 109 includes a grip 109*a* to be held by the user and an enlarged portion 109*b*. The enlarged portion 109*b* is formed forward of the grip 109*a* and enlarged forward in a generally flared manner. The concave portion 125 is integrally formed on the inside surface of the enlarged portion 109*b*. In this embodiment, as shown in FIG. 6, the concave portion 125 comprises two annular ribs 125*a* that extend (protrude) a predetermined length inward from the inside surface of the enlarged portion 109*b*. Each of the annular ribs 125*a* has an inner surface of a spherical shape which is complementary to the spherical surface 123*a* of the spherical portion 123, and is slidably engaged with the spherical surface 123*a* of the spherical portion 123. The two annular ribs 125*a* are disposed in parallel to each other with a predetermined spacing in the axial direction of the spherical portion 123. A pocket 125*b* is defined between the annular ribs 125*a*.

Figure 7:
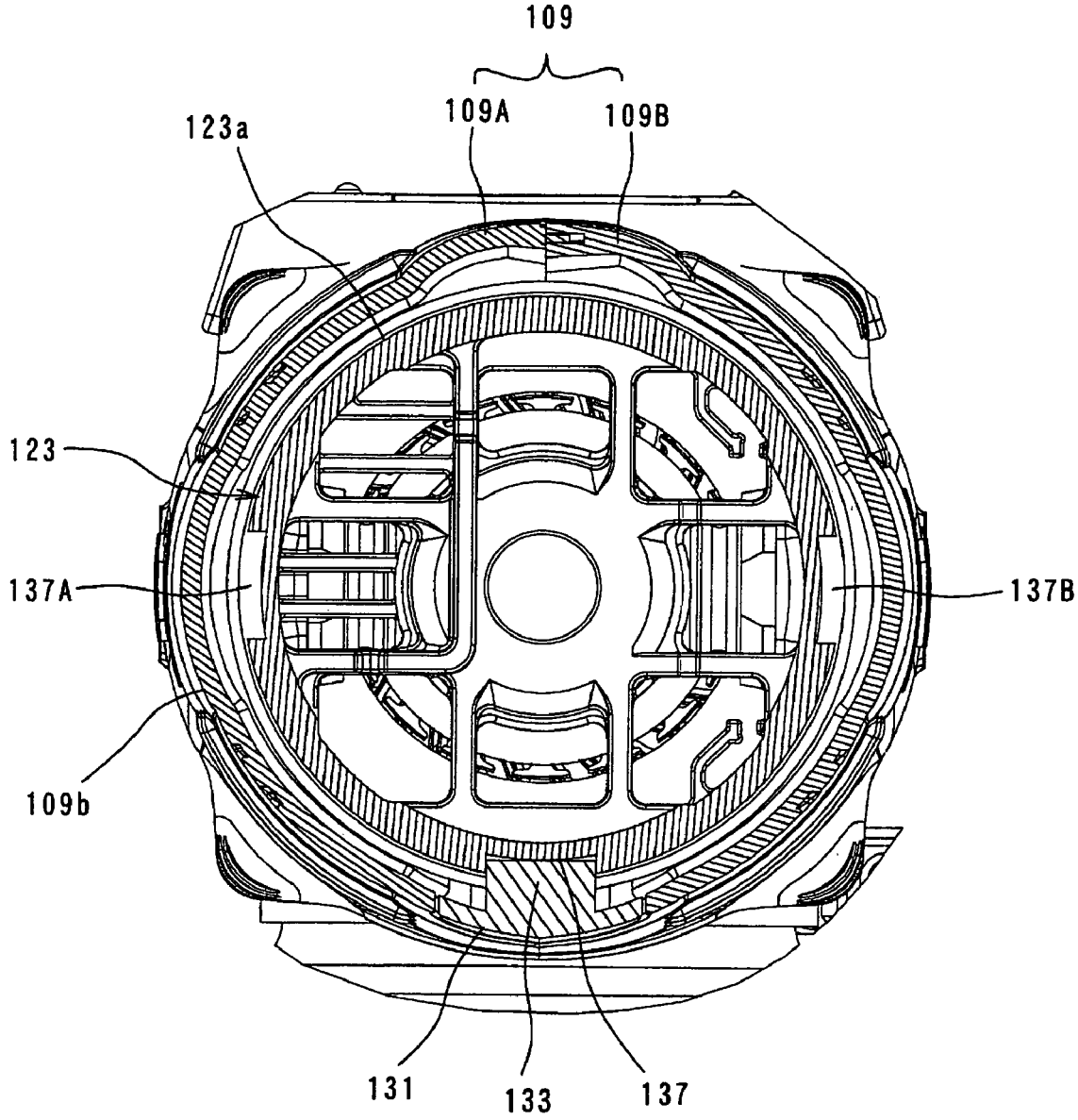
FIG. 7 is a sectional view taken along line VII—VII in FIG. 1.
Figure 8:
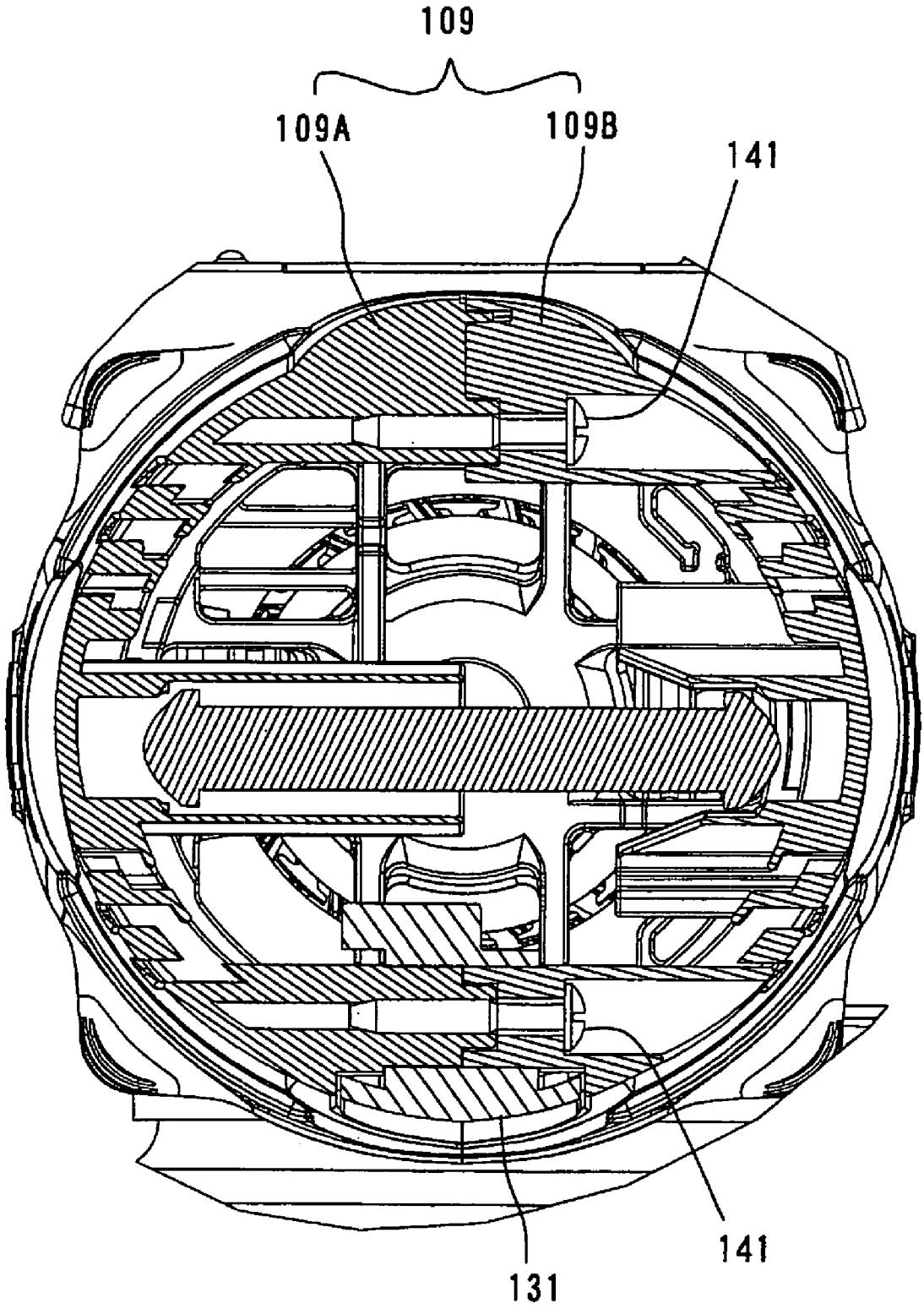
FIG. 8 is a sectional view taken along line IIX—IIX in FIG. 1.

As shown in FIGS. 7 and 8, the main handle 109 has a two-part structure which is divided into halves along a vertical plane on which the axis of the main handle 109 runs. Specifically, the main handle 109 comprises halves 109A and 109B. The halves 109A and 109B are butted against each other in such a manner that the concave portion 125 covers the spherical portion 123. In this state, the halves 109A, 109B are clamped together by through bolts 141 (see FIG. 8) at several predetermined points in order to mount the main handle 109 to the motor housing 105. The main handle 109 is connected to the motor housing 105 via the coupling region 121 and can rotate about the center P of the sphere of the spherical portion 123 in any vertical or lateral direction (all directions) as viewed from the longitudinal direction of the body 103. As shown in FIG. 6, a projection 123*b* to define the range of relative rotation of the main handle 109 is formed on the spherical surface 123*a* of the spherical portion 123 such that it is located in the pocket 125*b* between the annular ribs 125*a*. The projection 123*b* prevents the relative rotation of the main handle 109 by contact with the annular ribs 125*a*.

Figure 3:
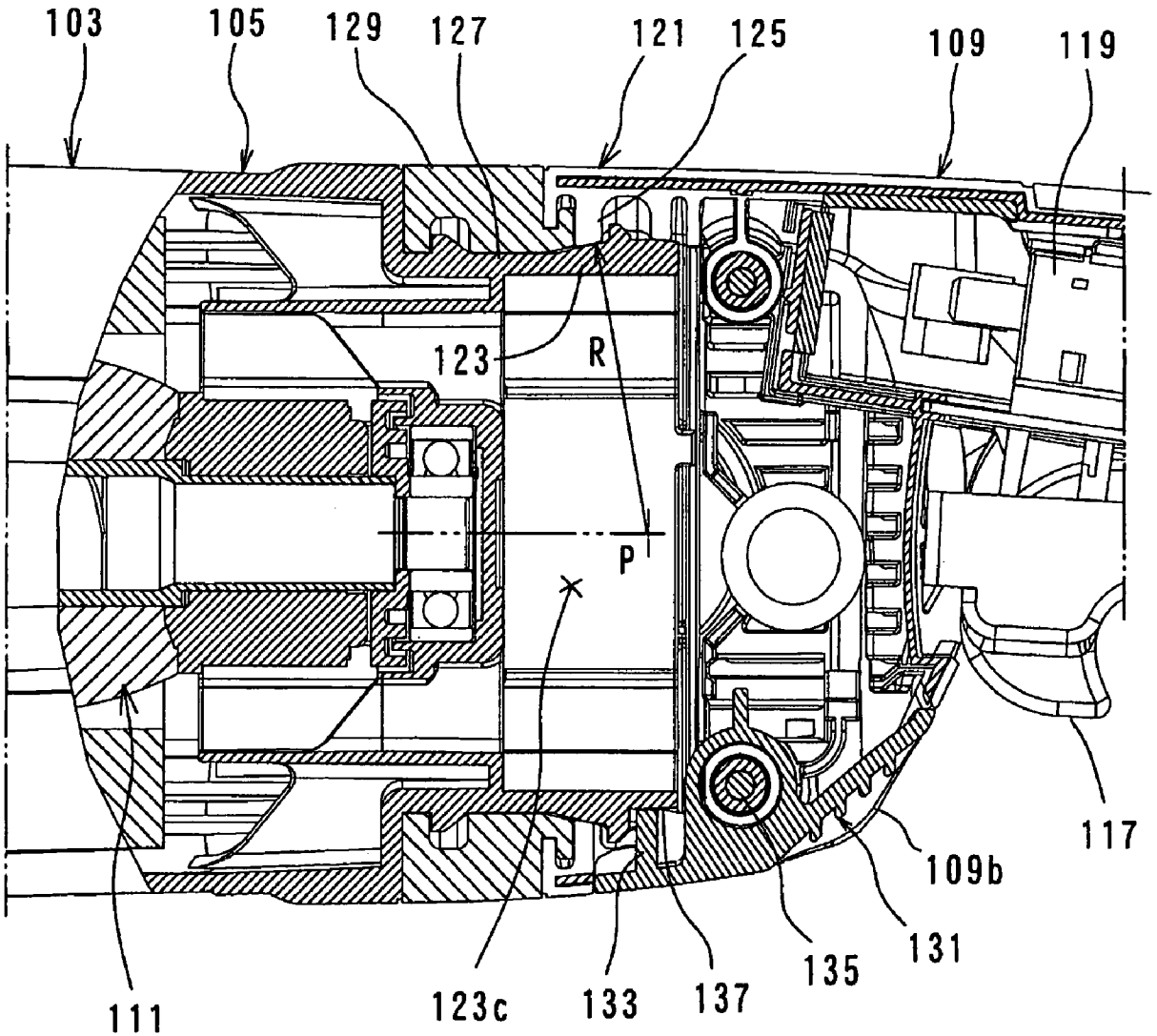
FIG. 3 is an enlarged view of circled part A in FIG. 1.
Figure 4:
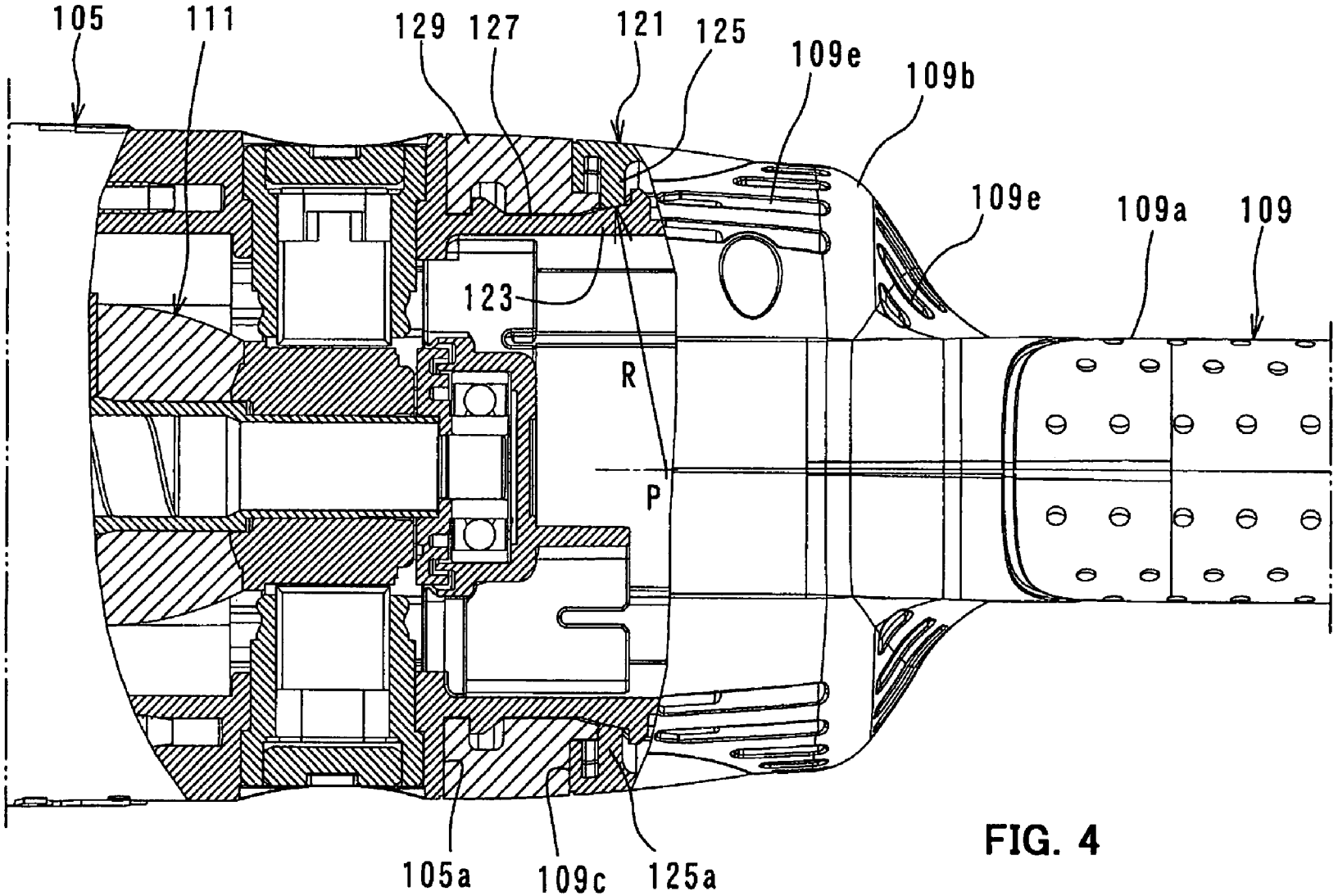
FIG. 4 is an enlarged view of circled part B in FIG. 2.
Figure 5:
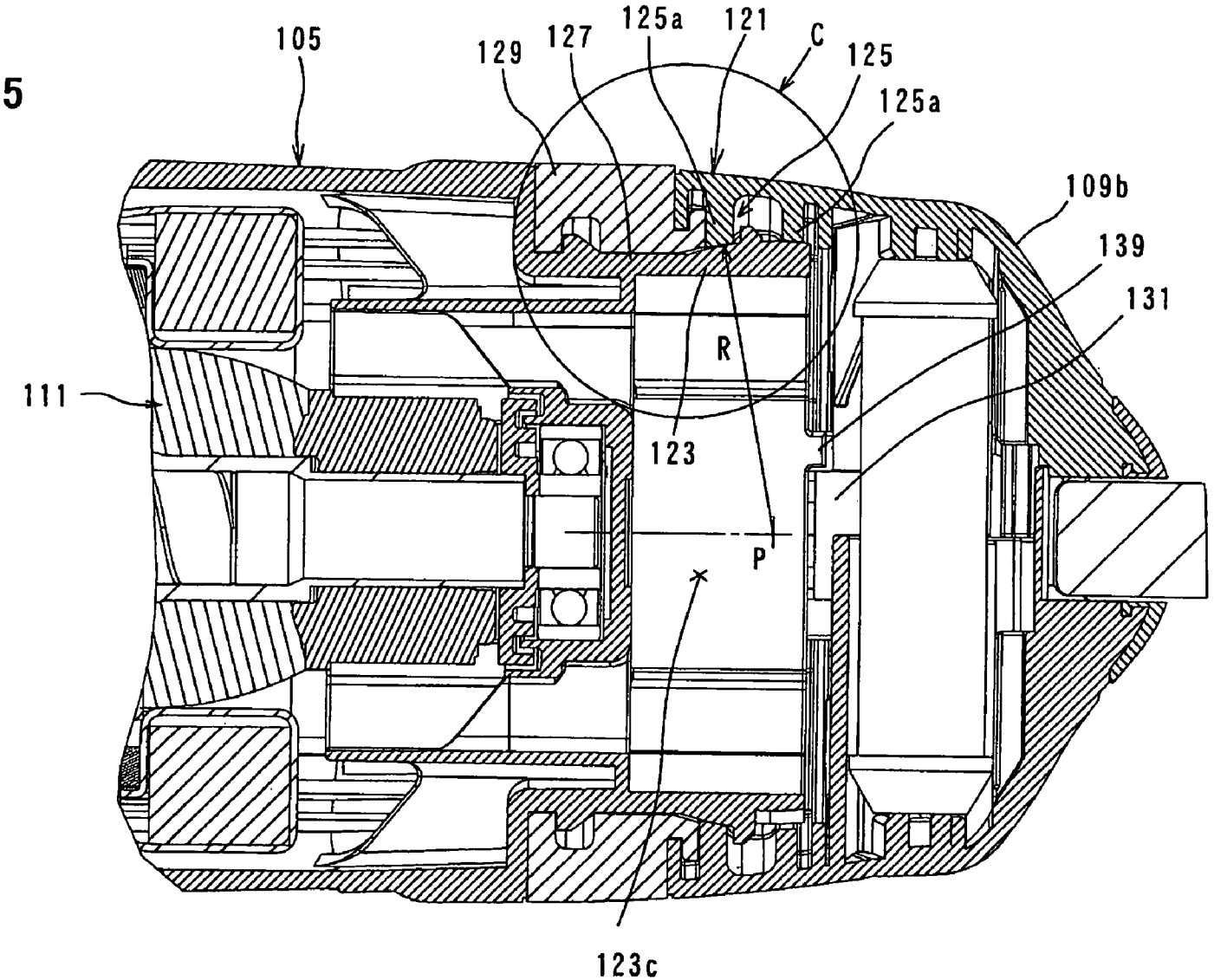
FIG. 5 is a sectional plan view showing the vibration-proof structure of a main handle.

As shown in FIGS. 3 to 5, a rubber isolator 129 is disposed between the main handle 109 and the motor housing 105 and applies a spring force to the main handle 109 against rotation of the main handle 109 in any direction with respect to the motor housing 105. The rubber isolator 129 is disposed in a region closer to the motor housing than the spherical portion 123 in a longitudinal direction "L" of the grinder 101 (see FIG. 1). The rubber isolator 129 is a feature that corresponds to the "elastic element" according to the invention. The rubber isolator 129 has a generally ring-like shape (see FIG. 13) and is fitted on the cylindrical portion 127 of the motor housing 105 such that it can rotate in the circumferential direction with respect to the motor housing 105. As shown in FIG. 6, one axial end (front end) of the rubber isolator 129 is in contact with the rear end surface 105*a* of the motor housing 105, while the other axial end (rear end) is in contact with a front end surface 109*c* of the main handle 109. Further, a flange 129*a* is formed on one axial end (front end) of the rubber isolator 129 and engages with an annular groove 127*a* of the cylindrical portion 127. On the other axial end (rear end), the rubber isolator 129 has a flange 129*b* that engages with an annular groove 109*d* of the main handle 109. In this manner, the rubber isolator 129 is securely fixed in the axial direction with respect to the motor housing 105 and the main handle 109.

The rubber isolator 129 is mounted on the motor housing 105 prior to the process of coupling the main handle 109 to the motor housing 105. The rear flange 129*b* is engaged with the annular groove 109*d* of the main handle 109 when the main handle 109 is coupled to the motor housing 105. Further, an annular groove 129*c* is formed around the inner surface of the rubber isolator 129 and serves to control the coefficient of elasticity of the rubber isolator 129. A projection 127*b* is formed on the outer surface of the cylindrical portion 127 and engages with the annular groove 129*c*. Thus, the rubber isolator 129 is prevented from moving to the main handle 109 side.

Further, the spherical portion 123 is hollow having a through hole 123*c* that extends axially through the spherical portion 123. The inner space of the motor housing 105 communicates with the inner space of the main handle 109 via the through hole 123*c* (see FIGS. 3 to 5). Vents 109*e* for air intake are formed in the enlarged portion 109*b* of the main handle 109. When the driving motor 111 is driven, air is taken in (sucked) through the vents 109*e* by a cooling fan (not shown). The intake air is then led into the motor housing 105 through the through hole 123*c* and cools the driving motor 111 within the motor housing 105. Thereafter, the air is discharged from the gear housing 107 to the outside. Here, the through hole 123*c* of the spherical portion 123 serves as a ventilation passage for introducing cooling air into the motor accommodation space within the motor housing 105. Further, as shown in FIGS. 1 and 3, a power switch 119 is disposed within the main handle 109 and actuated by the trigger 117 in order to start or stop the driving motor 111. The power switch 119 is connected to the driving motor 111 by a wire (not shown) installed through the through hole 123*c*. Thus, the through hole 123*c* also serves as a wiring passage for the wires that connect electrical components disposed within the motor housing 105 and electrical components disposed within the main handle 109.

The main handle 109 is coupled to the motor housing 105 via the spherical portion 123 and the concave portion 125. The main handle 109 can rotate around the axis of the spherical portion 123 in the circumferential direction with respect to the motor housing 105. On the other hand, however, if the main handle 109 may freely rotate around the longitudinal axis of the body 103, the orientation of the handle 109 (the direction of the grip) and the orientation of the grinding wheel 115 (the direction of the axis of rotation) will change and not accord with respect to each other, resulting that ease of use will be impaired. Therefore, in order to prevent such free rotation of the main handle 109 in the circumferential direction, as shown in FIGS. 3 and 9, a lock lever 131 is provided in the main handle 109. The lock lever 131 is a feature that corresponds to the "rotation preventing member" according to the invention. The lock lever 131 is disposed in a region of the enlarged portion 109*b* which is located on the lower side when the user grips the main handle 109 with the longitudinal axis of the body 103 held in a horizontal position. Further, the lock lever 131 is vertically rotatably mounted to the main handle 109 via a support shaft 135 that extends in a horizontal direction crossing the axial direction of the main handle 109. A generally rectangular engagement portion 133 is provided on one end portion (front end portion) of the lock lever 131 and protrudes inward. The engagement portion 133 can engage with an engagement groove 137 that is formed in the outer rear end of the spherical portion 123, so that the main handle 109 is locked against rotation around the axis of the spherical portion 123. Thus, the orientation of the handle 109 and the orientation of the grinding wheel 115 can be held constant with respect to each other.

The engagement groove 137 is configured such that the engagement portion 133 is substantially in point contact with both circumferential side wall surfaces 137*a* and a bottom 137*b* of the engagement groove 137 when the main handle 109 is prevented from rotating in the circumferential direction by engagement of the engagement portion 133 with the engagement groove 137 (as shown in FIG. 3). Specifically, as shown in FIG. 12, the engagement groove 137 extends a predetermined length in the axial direction of the spherical portion 123. Each of the side wall surfaces 137*a* comprises an inclined surface having a predetermined inclination θ with respect to a line X orthogonal to the axis of the spherical portion 123 such that the width of the engagement groove 137 is at the minimum in the middle in the length direction and at the maximum on the both ends. Preferably, the inclination θ of the inclined surface may be about 1 to 5 degrees. Further, the bottom 137*b* of the engagement groove 137 comprises a spherical surface which is concentrically formed with the spherical surface of the spherical portion 123 around the center P. With such construction, the engagement portion 133 engages with the engagement groove 137 substantially in point contact with the both circumferential side wall surfaces 137*a* and the bottom 137*b* of the engagement groove 137. As a result, the main handle 109 is allowed to rotate on the center P of the spherical portion 123 in all directions with respect to the motor housing 105 while being held prevented from rotating around the axis of the spherical portion 123 by the lock lever 131.

Generally, the grinder 101 may be used not only for grinding but for cutting a workpiece. In this case, a flat surface region (rotating surface 115*a* as shown in FIG. 1) of the grinding wheel 115 is mainly used to grind a workpiece, while a peripheral edge region (rotating circumference 115*b* as shown in FIG. 1) of the grinding wheel 115 is used to cut a workpiece. Specifically, the grinding operation is performed with the grinding wheel 115 held in a position in which rotating axis 116 of the grinding wheel 115 crosses the work surface of the workpiece, while the cutting operation is performed with the grinding wheel 115 held in a position in which the rotating axis 116 is parallel to the work surface of the workpiece. Thus, the orientation of the grinding wheel 115 is changed about 90 degrees according to whether a grinding operation or a cutting operation is performed. At this time, according to this representative embodiment, the direction (orientation) in which the user grips the main handle 109 is also changed about 90 degrees, so that ease of use is impaired.

Therefore, in accordance with the operation mode, the user can rotate the main handle 109 in order to change orientation of the main handle 109 between a grinding position in which the user holds the main handle 109 (or applies a grip) in a direction parallel to the rotating axis 116 (see FIG. 1) of the grinding wheel 115 and a cutting position in which the user holds the main handle 109 in a direction perpendicular to the rotating axis 116 (FIG. 1) of the grinding wheel 115, or a position in which the grinder is turned about 90 degrees clockwise or counterclockwise from the grinding position. The grinding position and the cutting position respectively correspond to the "rotating position" according to the invention. For the purpose of such change of orientation of the main handle 109, as shown in FIGS. 7 and 10, three engagement grooves 137, 137A, 137B are provided in the spherical portion 123 and the lock lever 131 can engage with and disengage from each of the engagement grooves. Of the three engagement grooves, the engagement groove 137 is provided for grinding operation and located on the lower side (in the middle between the other two engagement grooves) when the body 103 is held in a horizontal position. The other two engagement grooves 137A, 137B are provided for cutting operation and spaced 90 degrees apart from the middle engagement groove 137 in the opposite circumferential directions. The side walls and the bottom of the engagement grooves 137A, 137B for cutting operation are identically configured with those of the engagement groove 137 for grinding operation.

Further, when the user rotates the main handle 109, the rubber isolator 129 rotates together with the main handle 109. Specifically, it is configured such that the engaging force between the front flange 129*a* of the rubber isolator 129 and the annular groove 127*a* of the cylindrical portion 127 is weaker than the engaging force between the rear flange 129*b* and the annular groove 109*d* of the main handle 109. Thus, the rubber isolator 129 is caused to rotate with respect to the motor housing 105. Further, the engagement portion 133 engages with the engagement groove 137 when the user presses one end portion (front end portion) of the lock lever 131, while it disengages from the engagement groove 137 when the user presses the other end portion (rear end portion) of the lock lever 131. FIG. 3 shows the state of engagement between the engagement portion 133 and the engagement groove 137 and FIG. 9 shows the state of disengagement.

Further, a rotation stopper 139 in the form of a projection is provided near each of the engagement grooves 137A, 137B for cutting operation (see FIG. 10). The rotation stopper 139 contacts the lock lever 131 when the main handle 109 is rotated in the circumferential direction and thus prevents the main handle 109 from rotating over 360 degrees (in the neighborhood of about 290 degrees in this embodiment).

Operation and usage of the grinder 101 having the above-mentioned construction according to the representative embodiment will now be explained. During operation by the grinder 101, vibration is caused in the body 103 in different directions. The vibration which has been caused in the body 103 is absorbed, when transmitted to the main handle 109, by the construction in which the main handle 109 can rotate in all directions with respect to the motor housing 105 via the spherical portion 123 and the concave portion 125 and by elastic deformation of the rubber isolator 129 against such relative rotation of the main handle 109. Thus, the vibration which is transmitted from the body 103 to the main handle 109 can be reduced, so that usability of the main handle 109 can be enhanced.

Further, when the engagement portion 133 is disengaged from the engagement groove 173, 173A or 173B by rotating the lock lever 131 around the support shaft 135, rotation of the main handle 109 is allowed. In this state, the main handle 109 can be rotated on the axis of the spherical portion 123 in the circumferential direction. Therefore, the user can selectively change the position of the main handle 109 according to the working condition between a grinding position and a cutting position. Thereafter, the user can lock the main handle 109 in that selected position by engaging the engagement portion 133 of the lock lever 131 with one of the engagement grooves 173, 173A, 173B which is assigned to the selected position. As a result, the working operation can be performed with improved ease-of-use of the main handle 109.

Thus, the function of isolating vibration of the main handle 109 can be obtained with a simple construction in which the main handle 109 is coupled to the motor housing 105 such that it can rotate in all directions with respect to the motor housing 105 via the spherical portion 123 and the concave portion 125 and in which the rubber isolator 129 is disposed between the motor housing 105 and the main handle 109. Further, the function of adjusting the orientation of the main handle 109 with respect to the grinding wheel 115 can be obtained by selectively engaging the lock lever 131 with the engagement groove 137. In this case, the coupling region 121 comprises the spherical portion 123 integrally formed with the motor housing 105 and the concave portion 125 that is integrally formed with the main handle 109, so that the parts count can be reduced.

Further, the main handle 109 is prevented from moving in the longitudinal direction of the body 103 with respect to the body 103 because the main handle 109 is coupled to the motor housing 105 via the spherical portion 123 and the concave portion 125. Therefore, when the user performs any working operation with moving the main handle 109 in the longitudinal direction of the body 103, the body 103 can integrally move together with the main handle 109 in the longitudinal direction and thus, excellent feel of use can be obtained.

Further, with the construction in which the main handle 109 is prevented from rotating in the circumferential direction by the lock lever 131 while being allowed to rotate on the center P of the spherical portion 123 in all directions with respect to the motor housing 105, the orientation of the main handle 109 and the orientation of the grinding wheel 115 can always be held in a fixed positional relationship with respect to each other. As a result, the vibration isolating effect of the main handle 109 can be obtained without impairing ease of use.

Further, the hollow configuration of the spherical portion 123 can effectively provide a passage of air for cooling the driving motor 111 and a passage for wiring. Further, with the construction in which the rubber isolator 129 is disposed on the cylindrical portion 127 that is contiguous to the spherical portion 123, the distance from the center P of the spherical portion 123 to the rubber isolator 129 can be made longer. In other words, the rubber isolator 129 is disposed in a position in which the vibration amplitude of the main handle 109 increases, so that the rubber isolator 129 can efficiently absorb vibration. For example, if the rubber isolator 129 is placed nearer to the axis of the spherical portion 123 and at a longer distance from the center P (at a location in which the vibration amplitude is increased to a maximum), the trigger 117 or the power switch 119 will interfere with the rubber isolator 129. Therefore, the main handle 109 must be elongated in the axial direction, which results in increase of the whole length of the grinder 191. According to the representative embodiment, however, such a problem does not arise.

Further, the configuration of the concave portion 125 that comprises the plurality of annular ribs 125*a* can ensure a necessity minimum of the area of contact with the spherical portion 123 and permit reduction of the wall thickness of the main handle 109. Moreover, rotation of the main handle 109 with respect to the motor housing 105 can be stabilized. Furthermore, the contact surface of the concave portion 125 with respect to the spherical portion 123 can be narrowed in the axial direction, so that dusts which have entered between the contact surfaces of the spherical portion 123 and the concave portion 125 can be easily let out.

Further, the rubber isolator 129 is secured to the main handle 109 and the motor housing 105 by engagement between the flanges 129*a*, 129*b* and the annular grooves 109*d*, 127*a*. With this construction, the numbers of parts and manufacturing man-hours can be reduced, compared with a known construction in which a resin fixing component is adhered to the rubber isolator and then fixed to the main handle and the motor housing.

Further, because the coefficient of elasticity of the rubber isolator 129 can be appropriately adjusted by the annular groove 129*c* and the annular groove 129*c* is formed on the inner surface of the rubber isolator 129, the freedom of design of the outer surface of the rubber isolator 129 can be increased. Further, the rubber isolator 129 rotates together with the main handle 109 when the user rotates the main handle 109 around the axis of the spherical portion 123 in order to change orientation of the main handle 109. With this construction, the distance from the contact surfaces of the rubber isolator 129 and the motor housing 105 in the axial direction to the sliding contact surfaces of the spherical portion 123 and the concave portion 125 can be gained. As a result, even if dusts enter through a clearance between the contact surfaces, the dusts do not easily reach as far as the sliding contact surfaces.

Further, while the structure for engagement between the spherical portion 123 and the concave portion 125 is described as a spherical surface sliding structure having a sliding contact surface, it may be a spherical surface rolling structure having a rolling contact surface. Further, while the spherical portion 123 of the coupling region 121 is described as being formed on the motor housing 105 and the concave portion 125 on the main handle 109, the spherical portion 123 may be formed on the main handle 109 and the concave portion 125 on the motor housing 105. Further, the coupling region 121 may be formed separately from the motor housing 105 and the main handle 109.

Further, the invention may be applied to any other rotary power tool which performs an operation on a workpiece by rotation of a tool bit such as a polisher to perform a polishing operation.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

DESCRIPTION OF NUMERALS

101 electric disc grinder (rotary power tool)
103 body (tool body)
105 motor housing
105*a* end surface
107 gear housing
109 main handle
109*a* grip
109*b* enlarged portion
109*c* end surface
109*d* annular groove
109*e* vent
111 driving motor (motor)
115 grinding wheel (tool bit)
117 trigger
119 power switch
121 coupling region
123 spherical portion
123*a* spherical surface
123*b* projection
123*c* through hole
125 concave portion
125*a* annular rib
125*b* pocket
127 cylindrical portion
127*a* annular groove
127*b* projection
129 rubber isolator (elastic element)
129*a* front flange
129*b* rear flange
129*c* annular groove
131 lock lever (rotation preventing member)
133 engagement portion
135 support shaft
137 engagement groove
137A engagement groove
137B engagement groove
137*a* side wall surface
137*b* bottom
139 rotation stopper
141 through bolt

We claim:

1. A rotary power tool comprising:

a tool body, a rotary-disk shaped tool bit having a rotating surface, the tool bit performs a predetermined operation on a workpiece by a rotating movement around a rotating axis that extends perpendicular to the rotating surface, wherein the tool bit is disposed on one tip end region of the tool body such that the rotating axis extends to cross the longitudinal direction of the tool body, a handle coupled to the tool body at the end region of the tool body opposite to the region where the tool bit is mounted, the handle is disposed in a predetermined initial position in which the handle longitudinally extends parallel to the longitudinal direction of the tool body, a pivot region provided between the tool body and the handle, wherein the handle rotates with respect to the tool body around the pivot region in any direction crossing the longitudinal direction of the tool body and an elastic element disposed between the tool body and the handle, the elastic element applying a biasing force to the handle rotated around the pivot region with respect to the tool body such that the elastic element biases the handle to return to the initial position.

2. The rotary power tool as defined in claim 1, wherein the handle is prevented from moving relative to the tool body in the longitudinal direction of the handle.

3. The rotary power tool as defined in claim 1, wherein the elastic element is disposed between the tool body and the handle in a region closer to the tool body than the pivot region and wherein the elastic element applies a biasing force to the handle by being compressed and/or stretched between the handle and the tool body when the handle rotates relative to the tool body around the pivot region.

4. The rotary power tool as defined in claim 1, wherein the pivot region comprises a spherical portion provided on any one of the tool body and the handle and a spherical concave portion provided on the other of the tool body and the handle to engage with the spherical portion such that the concave portion relatively rotates with respect to the spherical portion.

5. The rotary power tool as defined in claim 4 further comprising a motor disposed within the tool body to drive the tool bit, wherein a through hole is formed through the spherical portion in the longitudinal direction of the tool body and serves as a ventilation passage for introducing air to cool the motor into the tool body.

6. The rotary power tool as defined in claim 1, wherein the handle has a rotation preventing member that prevents the handle from rotating in the circumferential direction around the longitudinal axis of the tool body while allowing the handle to rotate around the pivot region with respect to the tool body.

7. The rotary power tool as defined in claim 1, wherein the tool bit is defined by a grinding wheel arranged such that the axis of rotation of the grinder wheel extends in a direction crossing the longitudinal direction of the tool body, wherein the handle is operated by the user of the rotary power tool to rotate in the circumferential direction around the longitudinal axis of the tool body such that the handle is disposed in any one of multiple rotating positions around the longitudinal axis of the tool body, wherein the rotary power tool having a rotation preventing member that releasably prevents the handle from rotating around the longitudinal axis of the tool body from any one of the rotating position to the other rotating position, while allowing the handle to rotate around the pivot region with respect to the tool body.

* * * * *